US007145063B2

(12) United States Patent
Redard

(10) Patent No.: US 7,145,063 B2
(45) Date of Patent: Dec. 5, 2006

(54) TOP PICKUP FOR MUSICAL STRINGED INSTRUMENTS

(76) Inventor: Charlie Gordon Redard, 5852 Los Ranchos Dr., Buena Park, CA (US) 90620

( * ) Notice: Subject to any disclaimer, the term of this patent is extended or adjusted under 35 U.S.C. 154(b) by 174 days.

(21) Appl. No.: 10/941,681

(22) Filed: Sep. 15, 2004

(65) Prior Publication Data

US 2006/0054009 A1 Mar. 16, 2006

(51) Int. Cl.
*G10H 3/00* (2006.01)

(52) U.S. Cl. ..... 84/267; 84/723

(58) Field of Classification Search ..... 84/267, 84/723–725

See application file for complete search history.

(56) References Cited

U.S. PATENT DOCUMENTS 3,763,736 A * 10/1973 Williams ..... 84/329
3,868,880 A * 3/1975 Chapman ..... 84/267
3,911,777 A * 10/1975 Rendell ..... 84/743
5,200,569 A * 4/1993 Moore ..... 84/723
5,898,121 A * 4/1999 Riboloff ..... 84/728
5,929,362 A * 7/1999 Oteyza ..... 84/743
6,051,773 A * 4/2000 Rose ..... 84/743
6,770,807 B1 * 8/2004 Myers ..... 84/723
6,888,054 B1 * 5/2005 Minakuchi ..... 84/291
2002/0152880 A1 * 10/2002 Hogue et al. ..... 84/723

* cited by examiner

*Primary Examiner*—Gary F. Paumen
(74) *Attorney, Agent, or Firm*—Maria Erlinda Co Sarno

(57) ABSTRACT

A musical stringed instrument having a top pickup for producing variable tones and pitches. The top pickup is mounted on top of the strings. Present pickups are all mounted beneath the strings. The top pickup can be permanently mounted, slidably mounted and it can be made to swing into or out of the zone of the string vibration. The top pickup can be used independently or in combination with a bottom pickup or bottom pickups. The latter provide more variety of tones and pitches not achievable when the pickups are used independent of each other.

21 Claims, 10 Drawing Sheets

TOP PICKUP FOR MUSICAL STRINGED INSTRUMENTS

BACKGROUND

This invention relates to all musical stringed instrument such as acoustic and electric guitars, violins, basses, and the like, herein collectively referred to simply as guitar, having a top pickup with or without a bottom pickup. Musical stringed instrument and guitar, herein are used interchangeably to mean the same thing. A majority of pickups convert acoustic energy from the vibrations of the strings into electric energy which is electromagnetically amplified. The pickup function through magnetic interaction between the pickup and the strings. The pickups usually include magneto-electro transducer elements designed to detect vibrations of the guitar strings. There are other types of pickups, one function through piezoelectric action, the piezo elements responding to the changes in pressure caused by the vibrations of the string. Another functions by detecting variances in the light beam corresponding to the frequency of the string's vibration.

In playing a guitar, a player needs to be able to fine tune the instrument so as to read the strings at different positions along their length. Most conventional pickup assemblies adjust in position up and down to control the distance between the pickup and the strings but are usually mounted at a specific location along the length of the strings such that a musician usually buys a couple of guitars with different positions of the pickup for specific range of tones and pitches. This problem has been addressed by providing slidable pickups. Slidable pickups provide the capability of pickup adjustments in between usage. U.S. Pat. No. 6,051,773 discloses pickups slidably mounted within the cavity of the body beneath the plurality of strings and a cover mounted on the body between the slidable pickup and the plurality of strings. U.S. Pat. No. 3,911,777 likewise discloses an electric guitar with open slidable pickup beneath the strings. The latter claims that this type of pickups will allow the player to adjust the tones while playing. While a player can change the pickup position anytime with slidable pickups, there is a chance that the tones will get disrupted if on the process of moving the pickup, the player or musician, accidentally touches the strings because the slidable pickup of these cited inventions are all located beneath the strings. It requires manual dexterity to be able to reach into the pickup without touching the strings.

The claimed invention differ from the above because the pick up is mounted on top of the strings, herein referred to as top pickup. The top pick up may be combined with at least one pickup mounted within the cavity of the guitar body beneath the plurality of strings, herein referred to as bottom pickup. To cover the full range and variety of tones and pitches, both the top and the bottom pickups are preferably but not necessarily slidable in a direction parallel to that of the strings. The top pickup, being above the strings, can be easily moved without disrupting the string and consequently, the tone. The top pickup can produce tones different from the bottom pickup. A slidable top pickup combined with a bottom pickup gives more flexibility and more variety of tones. With the use of both a permanent or slidable top pickup and a permanent or slidable bottom pickup, tones, pitches and harmonics different from and not reproducible with just the bottom pickups are achievable. A musician can choose to use only the top pickup, only the bottom pickup or both top and bottom and if there are more than one bottom or top pickups, select all these or a combination of these.

When one calculates the number of combinations possible, one can see the flexibility and the number of tones possible with the application of the claimed invention.

It is therefore an object of this invention to provide a musical stringed instrument with more variety of pitches and tones.

It is also an object of this invention to provide a slidable pickup that can travel at a greater distance along a guitar with a longer neck and longer cavity thereby producing pitches and tones not previously attainable.

It is a further object of the invention to provide a top pickup for musical stringed instruments.

It is also a further object of this invention to provide a top pickup that is readily slidable without the risk of touching on the strings.

It is still a further object of this invention to provide a top pickup that is not only slidable but also removable at will from the zone of the string vibration depending on the desired tone and pitch.

It is also a further object of this invention to provide multiple permanent or slidable bottom pickups.

SUMMARY OF THE INVENTION

The claimed invention relates to musical stringed instruments comprising a body including a neck and a bridge having anchoring elements supporting a string or a series or plurality of strings and a top pickup mounted on top of the series or plurality of strings. The top pickup is usually installed on a front panel of the guitar or stringed instrument. The top pickup may be permanently mounted on a location on top of the string/s or it can be slidably mounted on top of the string/s to allow the top pickup to traverse in a direction parallel to that of the string/s, that is, along the usable length of the string/s. Usable length means the length of the string that produces tones and pitches agreeable to the players or musicians. The top pickup can also be constructed to allow the top pickup to swing in and out of a zone of the string vibration. The top pickup can be combined with a bottom pickup which may be permanent or slidable. The bottom pickup is mounted on a rear panel, inside a cavity of the stringed instrument, beneath the string/s. In a guitar with both top and bottom pickup, their respective transducers face towards the string and towards each other but not necessarily directly. The slidable bottom pickup, like the slidable top pickup, traverse in a direction parallel to that of the string/s, that is, along the usable length of the string/s. For both the top and the bottom pickup, the distance between the pickup and the string/s is maintained. The top and bottom pickup can also be a single or a double pickup and in guitars with both top and bottom pickups, any combination of these are possible. There can be more than one top or bottom pickup and the choice is at the discretion of the player or manufacturer, the former concerned with tones and pitches, the latter concerned with practicality of design. A switch or switches may be provided to activate or inactivate the pickups. There are different methods and designs for installing the pickups, for effecting slidable movements as well as enabling the adjustments of their respective positions in relation to the string to maintain the same distance between them.

BRIEF DESCRIPTION OF THE DRAWINGS

FIG. 3A shows how the hex screw is introduced into the pickup holder.

FIG. 3B shows the components of a hex screw and how they are assembled for use.

FIG. 4 shows a spring enveloped hex screw.

FIG. 4A shows how the spring enveloped hex screws is used to attach a pickup to the pickup holder.

DETAILED DESCRIPTION OF THE INVENTION

Figure 1:
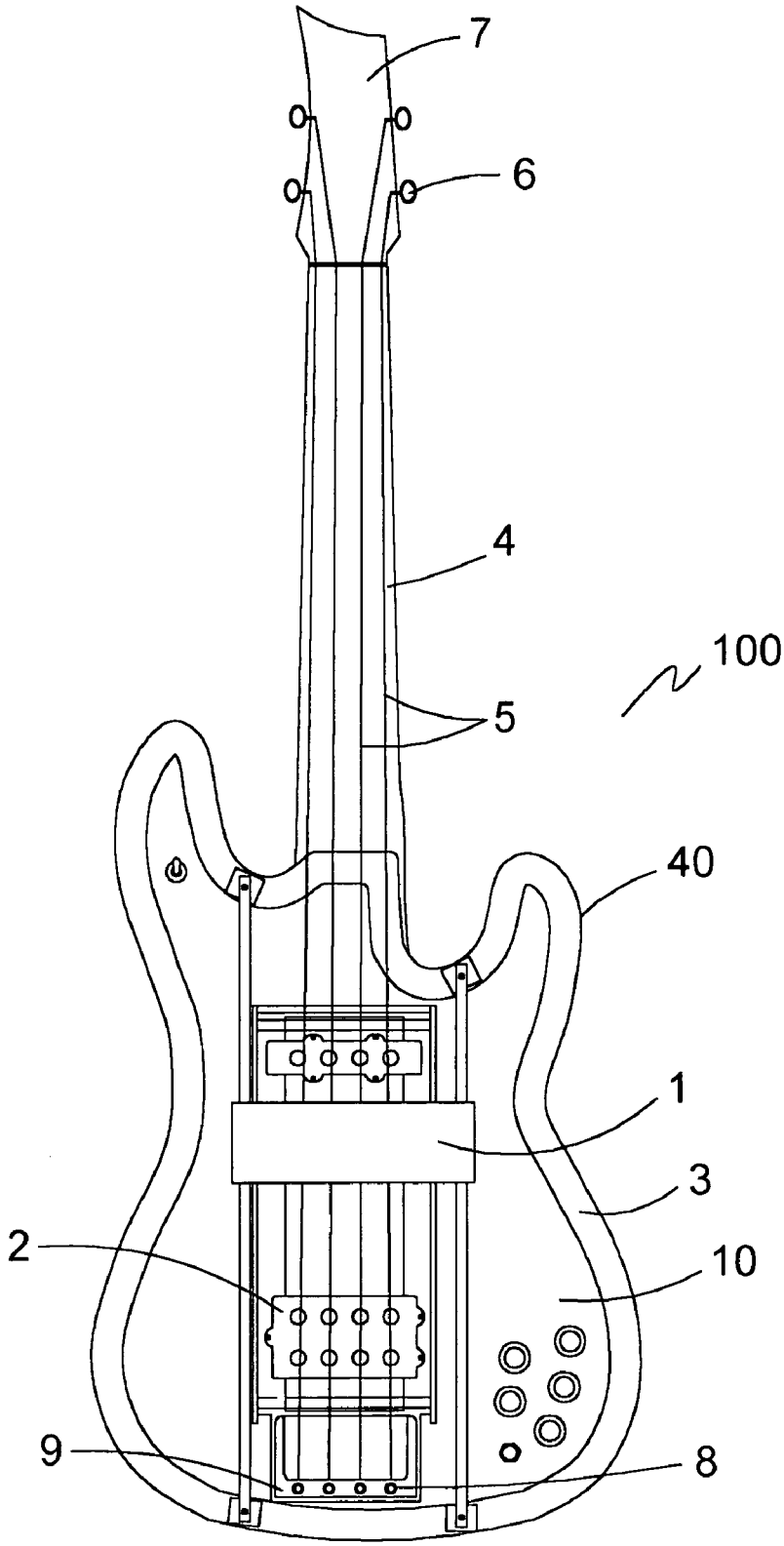
FIG. 1 is a front view of a guitar having a top and a bottom pickup.
Figure 1A:
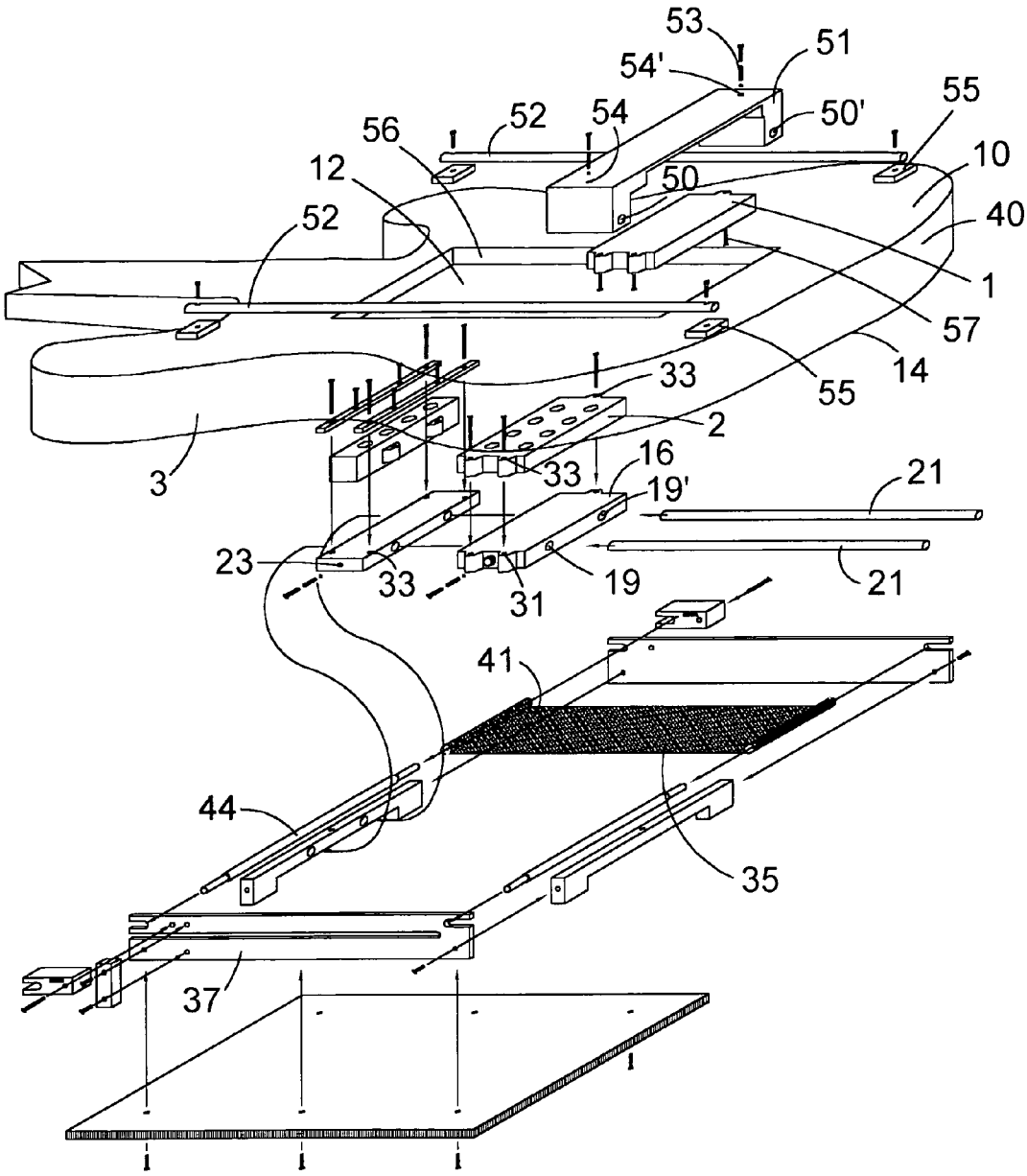
FIG. 1A is an exploded view of the assembly of the guitar.

The detailed description represented herein is not intended to represent the only way or the only embodiment in which the claimed invention may be practiced. The description herein is provided merely as an example or examples or illustrations of the claimed invention and should not be construed as the only way or as the preferred or advantageous over other embodiments or means of practicing the invention. The detailed description includes specific details to provide a thorough understanding of the claimed invention and it is apparent to those skilled in the art that the claimed invention may be practiced without these specific details. In some instances, well known structures and devices are shown in block diagrams or drawn with broken lines in order to avoid obscuring the main concepts of the invention. FIGS. 1 and 1A show a guitar 100, including a top 1 and a bottom 2 pickup. A guitar with just a top pickup will look similar except for the absence of bottom pickup. The description herein describes both the top and the bottom pickup because one can just pick and choose depending on the type and number of pickups desired. Although the illustration shows a bass guitar, the claimed technology applies equally to all types of musical stringed instruments such as solid and hollow body guitars, as defined and mentioned above, having the conventional or desired number of strings. A typical guitar includes a solid or hollow body 3 and a neck 4 secured to one end of the body 3. The neck supports a string or a series of strings 5 which extends from a first anchoring element 6 at the neck 4 or headstock 7 of the guitar to a second anchoring element 8 of a bridge 9 of the guitar. The bridge is located near the bottom of the front panel 10 of the body 3 as shown in FIG. 1. The assembly for facilitating fixation and tightening of the strings with respect to the body and/or neck of the guitar are variably design and is not part of the claimed invention. The strings correspond to the musical notes. The first 6 and second 8 anchoring elements are critical contact surfaces because it determines the length of the string/s 5 and the latter affects the frequency of the tone produced by the guitar, that is, the distance between the two contact surfaces define the harmonic length of the string.

Figure 2:
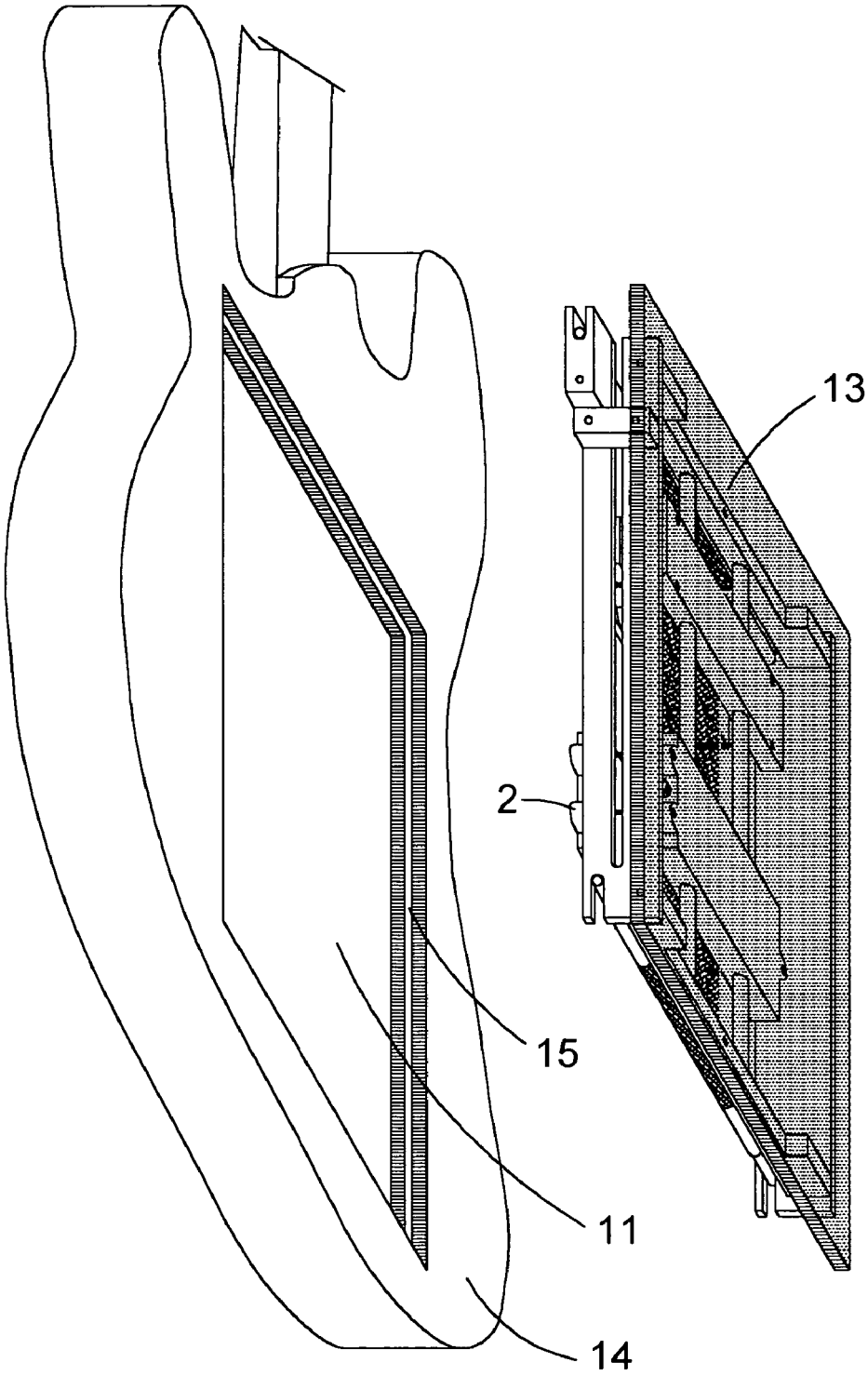
FIG. 2 is an exploded rear view of the guitar with portion of the rear panel etched out to accommodate a bottom pickup with a rear panel.

The guitars with a solid body 3 should have a cut out cavity 11 to accommodate a bottom pickup 2, if needed. The bottom pickup is installed inside the cavity 11. A new guitar can be manufactured with the cut out cavity while an old guitar can be modified to accommodate a bottom pickup because the bottom pickup is recommended to be assembled separately and then introduced into the guitar either by attachment on the inside wall 12 of the rear panel of the guitar or by providing a rear panel 13 on the assembled bottom pickup. With the latter, the rear panel 13 of the bottom pick up assembly will serve as part of the rear panel 14 of the guitar which has an opening etched out matching the dimensions of the rear panel 13 of the bottom pickup as shown in FIG. 2. The rear panel 13 situates on the peripheral lips 15 recessed from the top surface of the rear panel 14 to result in a smooth coplanar outside surface between the rear panels 13 and 14.

Figure 3:
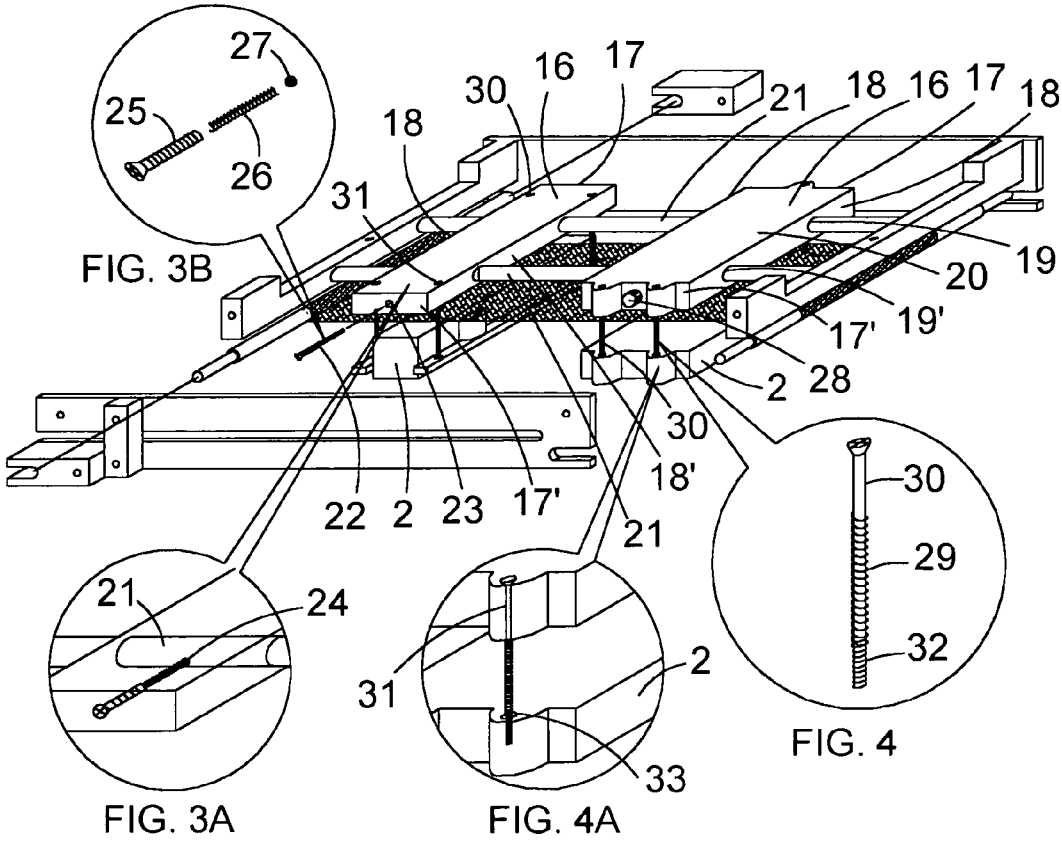
FIG. 3 is a perspective view of the bottom pickup assembly in an upside down position showing the attachment of the hex screws and the canvas to the brackets.

The bottom pickup 2 is assembled by attaching to a pickup holder 16. FIG. 3 shows a partially assembled upside down two-bottom pickup, that is, with the pickup holder 16 on top and two bottom pickups 2 at the bottom. After assembly, this will be turned to make the bottom pickup face the string/s 5. FIG. 1A is an exploded view of the components of one example of a guitar practicing the claimed invention. The pickup holder 16 is a plate having two lateral sides 17, 17' and two horizontal sides 18, 18'. On the horizontal sides, there are preferably for balance, two channels 19, 19', drilled through the body 20 of the pickup holder 16. Two tracking bars 21 of equal length are introduced in each channel. To keep the pickup holder from uncontrollably sliding along the tracking bar or keep the pickup holder temporarily fixed at a certain desired location, a special tension adjusting hex screw 22 is introduced at a cylindrically shaped opening 23 located on the lateral sides 17, 17' of the pickup holder 16. The end 24 of the opening 23 reaches to the tracking bar 21. A shown in FIGS. 3A and 3B, the hex screw comprises a hex 25, a spring 26 and a ball bearing 27. The spring 26 is sandwiched between the hex 25 and the ball bearing 27. The spring does not envelope the hex but is of a smaller diameter of turn compared to the diameter of the hex and the ball. With the tracking bars introduced into the channels 19 and 19', the ball bearing is first inserted into the opening 23 followed by the spring and then the hex. The tension adjusting hex screw 22 is recommended to have a knob 28 for easily adjusting the degree of tension or frictional force between the ball of the ball bearing and the tracking bar. The hex screw 22 is applied at a position that would allow the pickup holder to change position along the tracking bar with a slight manual push of the pick up holder but would stay stationary if left undisturbed at the desired location. While the pickup holder is being moved, the spring 26 in between the hex and the ball bearing is compressed. When it is at the desired location, the pickup holder is released to relax the spring to its uncompressed state which will temporarily fix the pickup holder because the spring 26 will press on the ball bearing. The movement is prevented by the frictional force between the ball bearing of the hex screw and the tracking bar. One hex screw is usually not enough. For balance, it is recommended to have one on each lateral sides 17, 17' of the pickup holder, directed from the sides of each tracking bar. This illustrated assembly will keep the pickup holder balanced during its motion along the tracking bar and also have enough frictional force to keep it steady on the tracking bar. Other means of assembling the pickup holder are possible and the above illustration serves only as an example or as a guide in designing other pickup holders that can function similarly.

Figure 5:
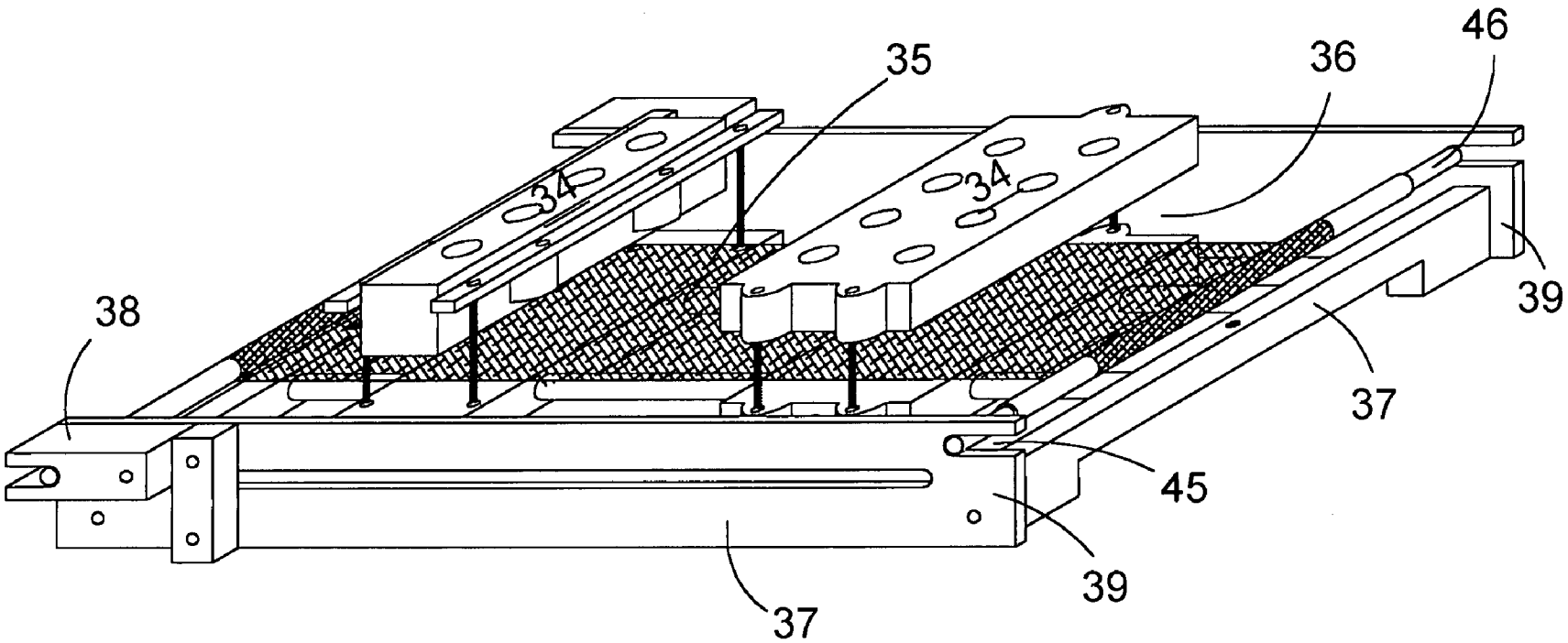
FIG. 5 shows a two bottom pickup assembly, one single and one double.
Figure 6:
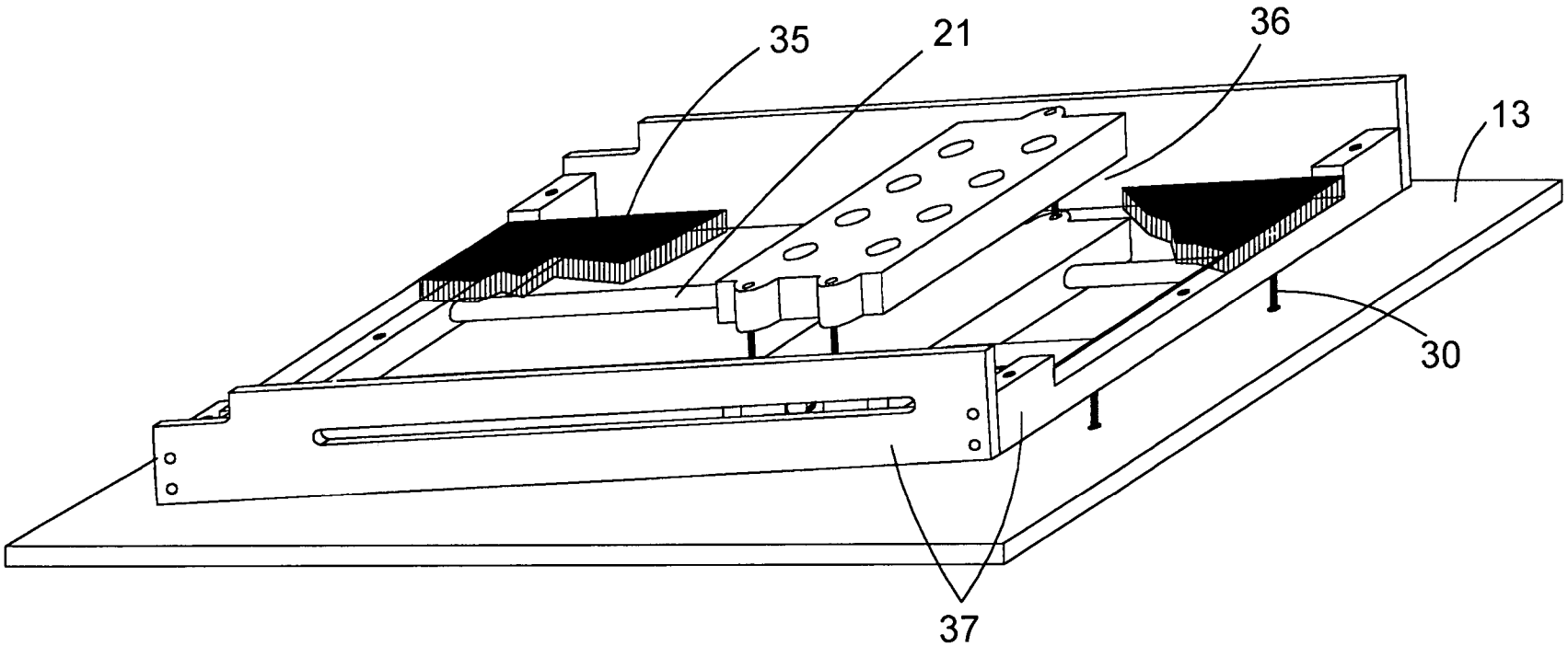
FIG. 6 shows a pickup assembly having a solid pickguard.
Figure 6A:
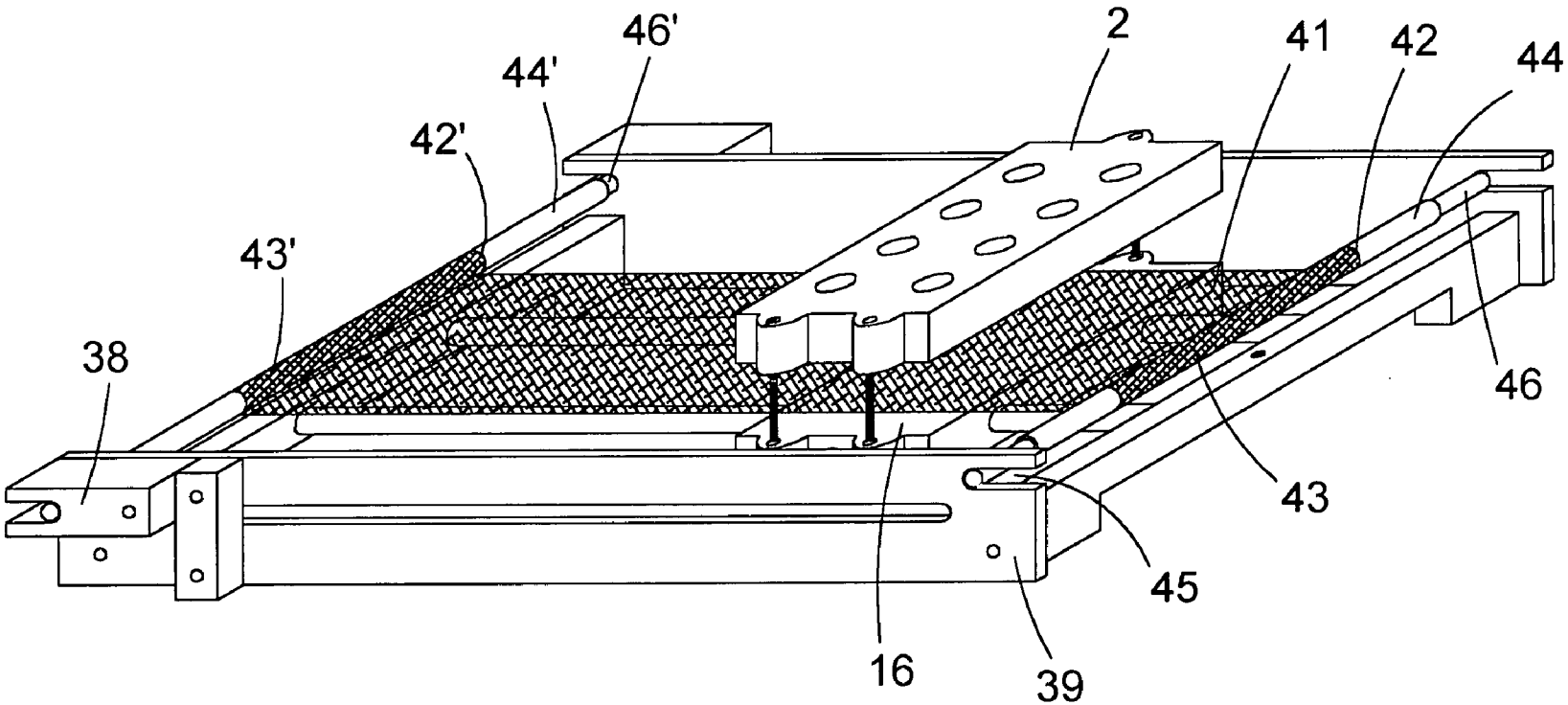
FIG. 6A shows a pickup assembly having a canvas or similar material as a pickguard.

To attach the bottom pickup 2 to the pickup holder 16, another type of screws 30 are used. In these screws, the spring 29 envelopes part of the hex as shown in FIG. 4. As is customary in the art, a single pickup, one having one or a single row or line of pickups, are attached to the pickup holder with four screws while a double pickup, one having two rows or lines of pickups, are attached with three screws, one on one lateral end and two on the opposite lateral end. The number and positions of attachment are at the discretion of the manufacturer and need not follow the custom of the trade. Also, the number and type of pickup, single or double, are at the discretion of the player or the manufacturer. FIGS. 1, 3 and 5 show both single and double bottom pickups. As shown in FIG. 4A, the screw is introduced on the openings 31 drilled through the top surface of the pickup holder (this side becomes the bottom surface after the pickup assembly is turned upside down). The hex 30 is longer than the hex 25 used to position the pickup holder on the tracking bar. The hex without the spring is introduced into opening 31 of the pickup holder 16. The hex 30 will protrude beyond the height or thickness of the pickup holder. At the protruding end, the spring 29 is introduced and will occupy the space or distance between the pickup and the pickup holder. The spring envelopes this portion of the hex 30 between the pickup and the pickup holder. To differentiate this hex screw 30 from the other, this will be referred to as spring enveloped hex screw 30. The bottom end 32 of the spring enveloped hex 30 screw is in turn inserted into a matching opening 33 at the surface of the bottom pickup 2 directly opposite 31. The opening 33 does not go all the way through the thickness of the bottom pickup but only at a depth enough to accommodate and secure the spring enveloped hex screw 30. The opening 33 is preferably threaded to be able to control the distance or length of the bottom end 32 of screw 30 going inside the opening which is also preferably correspondingly threaded. The bottom end 32 of the hex screw 30 going inside opening 33 does not have a spring. The turn diameter of the spring 29 is larger than both openings 31 and 33 and therefore stays between the pickup and the pickup holder. The length of the spring 29 covers the distance between the pickup and the pickup holder. This type of attachment allows the adjustment of the distance between the pickup holder and the pickup which consequently adjusts the distance between the strings 5 and the bottom pickup 2. The distance between the strings and the bottom pickup affects the tone produced by the guitar. Depending upon the desire of the musician and dictated by the length of the cavity 11 and the length of the tracking bars 21, additional bottom pickups may be added. Practically, the cavity should be able to accommodate four bottom pickups but this can be more depending upon the type and size of the pickup and the size of the cavity. It is probable that pickups smaller in size than what is presently in the market will be commercially available in the future. The bottom pickups may be all singles or all doubles or a combination of these. FIG. 5 shows an example of a two bottom pickup assembly 34, one single and one double. It is important to be able to adjust the distance between the string and the pickup. Since some of the guitars have strings that are not horizontally straight or co-planar between the two anchoring elements but at an angle, the bottom pickup assembly 34 in this case, should be supported by a pickguard 35 angled similarly as the strings. The pickguard 35 is introduced on the horizontal side 36 of the bottom pickup assembly 34 usually situating above the pickup holder, sandwiching between the pickup holder and the pickup. The pickguard is between the bottom pickup and the pickup holder after the assembly is turned upside down from the direction shown in FIG. 3. Because the pickup holder is held by the tracking bars, if the pickguard and the tracking bars are inclined, the whole pickup assembly will traverse along the tracking bar at the same inclination. The pickguard also serves a cosmetic purpose of hiding the tracking bar and the electrical connections from view. The pickguard may be made of cloth or canvas or a solid hard material such as plastic. To angle the pickguard 35, it must be supported by pickguard supports 37 that are angled accordingly. FIG. 6 shows position of a hard solid pickguard such as a plastic pickguard in relation to the pickup holder and the pickup. For a pickguard made of canvas or other similar fabrics, herein simply referred to collectively as canvas, as shown in FIGS. 5 and 6A, the neck end of the pick up assembly must be supported by a bracket 38 lower or shorter than the bridge bracket 39. The canvas pickguard 41 as shown in FIG. 6A has a welt like loop 42 sewn on the lateral ends 43 to enable a rolling rod 44 to go through the welt like loop. For this example, the brackets 38 and 39 should be able to hold the rolling rods which is typically done by having a 'C' like opening 45 on its ends where the exposed ends 46 of the rolling rod 44 can slip through as shown in FIGS. 5 and 6A. To assemble, a rolling rod 44 is introduced into the welt like loop 42 on one end 43 of the canvas and the exposed ends 46 of the rod are inserted into the 'C' opening of bracket 39. The canvas is then inserted between the bottom pickup 2 and the pickup holder 16. After insertion, a second rolling rod 44' is slipped into the welt like loop 42' on the other end 43' of the canvas and like the end 43, the exposed ends 46' of the rod 44' is inserted on the 'C' opening of bracket 38. The 'C' opening of bracket 39 faces down towards the bridge while the 'C' opening of bracket 38 faces up towards the neck. After placement of the two ends 43 and 43', the canvas should not be loose but in a slightly stretched state to allow the pickup to freely move along the canvas as well as keep the rolling rods secured inside the respective 'C' openings. Alternately, a single piece of canvas may be made to wrap around the rolling rods 44 and 44', with the resulting ends sewn together. This will result in two layers of canvas akin to a rolling conveyor belt. To introduce this between the bottom pickup and the pickup holder, one rolling rod is temporarily removed from one end as the double layered canvas is introduced between the pickup and the pickup holder. After insertion, the rolling rod is brought back and both rolling rods are made to rest on their corresponding 'C' openings at brackets 38 and 39. Aside from the illustration above, there are different ways of angling the pickguard 35 which will also angle the pickup holder and consequently, the bottom pickup so that the distance between the string and the bottom pickup stays the same regardless of the position of the bottom pickup along the pickguard or the tracking bar holding the pickup assembly. Obviously, pickguards for guitars that have co-planar strings need not be angled. In this case, the pickguard serve more of a cosmetic purpose. The position of the bottom pickup in relation to the string affect the tone and pitch. Increasing the number and/or variety of bottom pickups offers another means of producing additional or different tones and pitches because one pickup assembly will amplify the vibrations on one location of the string while another pickup will amplify the vibrations of the string at another location. It is known that strings produce different tones and/or pitches depending upon their distance from the neck or bridge of the guitar. If the bottom pickup assembly is going to be mounted to a rear panel 13, the pickguard supports or brackets on the bridge end of the assembly may be attached to the rear panel with spring enveloped screws like the hex screw 30 for further ability to adjust the inclination of the pickguard and the tracking bar as shown in FIG. 6.

For guitars with a hollow body, the bottom pickup assembly 34 can be installed on the rear panel 14 before the rear panel is attached to the side panels 40. On an old guitar with a hollow body and a front opening beneath the strings, the bottom pickup assembly can be attached to the inside wall 12 of the rear panel after the temporary removal of the strings.

Figure 7:
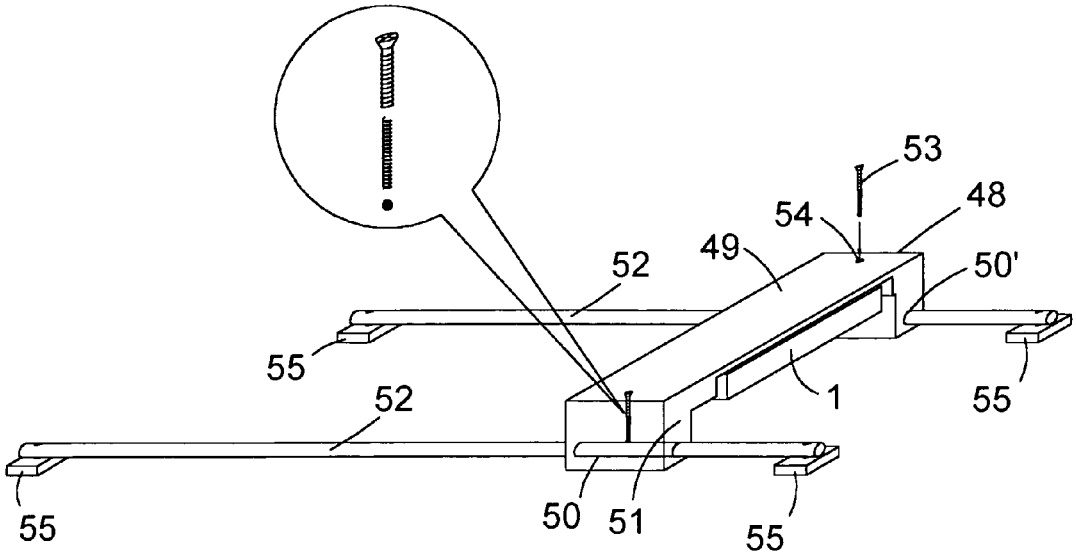
FIG. 7 is a perspective view of a top pickup assembly.
Figure 9:
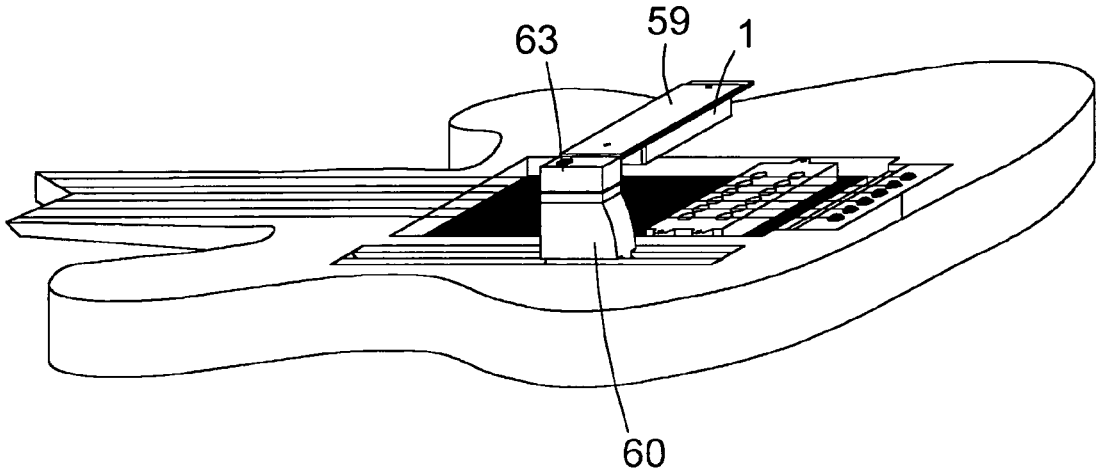
FIG. 9 shows a guitar with the swinging slidable top pickup.

A top pickup can be installed with or without a bottom pickup. A slidable top pickup traversing along the usable length of the string, that is, parallel to the string is preferred for the same reasons presented for slidable bottom pickups. The invention herein claim the advantages of providing a top pickup for the production of additional tones different from or the same as those produced by the bottom pickups. Consequently, a guitar with a permanent top pickup is also within the scope of this invention. This claimed invention covers all guitars incorporating a top pickup, slidable or permanent, with or without a bottom pickup, with the bottom pickup, permanent or slidable, and combinations of these. The transducer of the top pickup faces the strings. The top pickup 1 is assembled similarly as the bottom pickup 2 except that there is no need to turn the top pickup assembly 48 shown in FIG. 7 upside down after the assembly. There is also no need to install a pickguard. The top pickup 1 is mounted on top of the front panel 10 of the guitar above the string/s 5 having the desired clearance between the top pickup and the strings as shown in FIG. 9. As in the bottom pickup assembly 34, the top pickup 1 is attached to a top pickup holder 49 having two channels 50, 50' bored through the body 51 of the top pickup holder 49. Another set of tracking bars 52 of equal length are introduced in each channel. To be able to temporarily fix the position of the top pickup along the tracking bars, two tension adjusting hex screws 53 similar to the hex screw 22 are introduced into two cylindrical openings 54, 54' located on top of the pickup holder 49 as shown in FIGS. 1A and 7. In the same manner as above, the end of the openings 54, 54' reaches the respective tracking bars. The hex screws 53 are introduced into these openings in the same manner as hex screw 22 and is moved or fixed along the tracking bar similarly as well. The top pickup 1 is attached to the top pickup holder 49 with a spring enveloped hex screw 57, the same as the spring enveloped hex 30 used for the bottom pickup which will not be reiterated. As in the bottom pickup, the spring enveloped hex 57 is used to adjust the distance between the top pickup and the top pickup holder and consequently, the distance between the top pickup and the strings. After attachment of the top pickup to its holder, the tracking bars 52 are mounted on the front panel 10 having spacers 55 between the bars and the front panel. The spacers serve to maintain a distance between the top pickup and the strings when the top pickup is positioned along the tracking bar 52. The top pickup assembly traverses the tracking bars 52 along the same reach of distance as or farther than the slidable bottom pickup assembly 34, the latter more limited by the length 56 of the cavity 11. Because the top pickup is mounted on the top surface of the front panel, old guitars can easily incorporate a top pickup, if desired.

For guitars with a top and bottom pickup, it is recommended to install the bottom pickup before the top pickup. After the installation of the bottom pick up on the rear panel of a guitar, the top pickup is installed. The transducer/s of the bottom pickup 2 face towards the transducers of the top pickup 1, not necessarily directly. Consequently, the transducer/s of the top pickup faces the strings and the transducer/s of the bottom pickup faces the strings as well. The top pickup can traverse to a location above the cavity, away from the bottom pickup, and still produce yet another tone because the transducers on the top pickup picks the vibrations of the strings at a neck or proximal to the neck location away from the cavity and the bottom pickup. As is customary in the field, a switch or several switches activates or inactivates the top or the bottom pickup/s.

Figure 8:
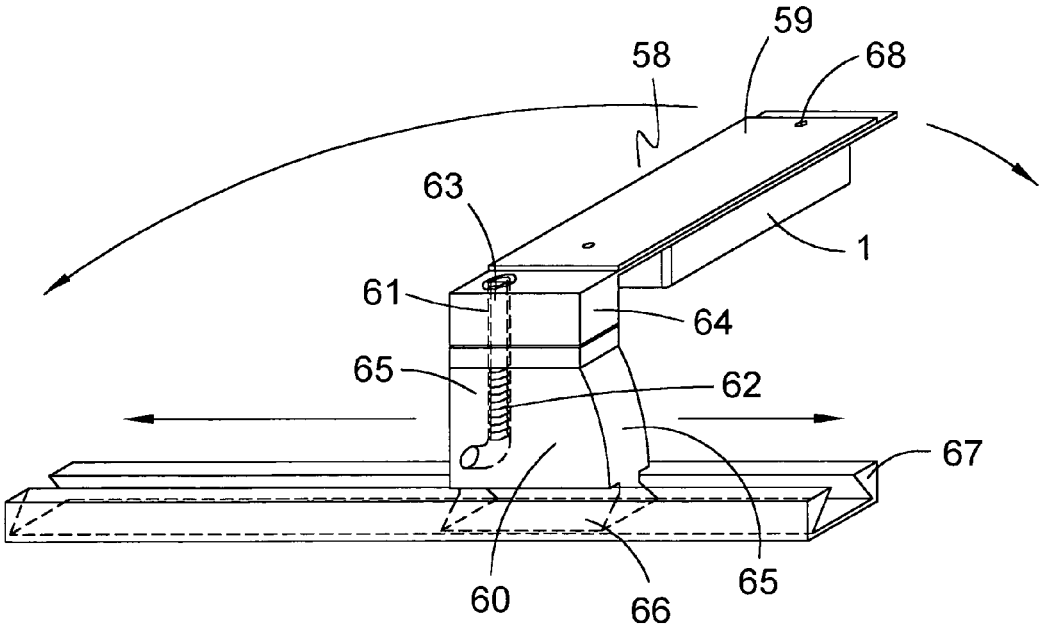
FIG. 8 is a perspective view of swinging slidable top pickup assembly.

The top pickup 1 can also have a pickup holder 58 that can swing towards the string and away from the strings as shown in FIG. 8. This will allow the player to adjust the position of the top pickup, not just perpendicularly above and across the strings but also at an angle, catching the vibrations of the string, each at different lengths. This provides another flexibility and variation in tones not present with top pickups permanently mounted across the strings. Further, with a swinging top pickup assembly, a player can easily remove the top pickup from the zone of the string vibration or tone detection and bring it back while playing without worrying about touching a string or switching to activate or inactivate the top pickup. Of course, the top pickup may also be placed or removed entirely out of the zone of detection when not needed during the entire play instead of just inactivating it by a switch.

The swinging top pickup holder 58 includes a plate 59 having a top, a bottom, two horizontal sides and two lateral sides with one lateral side connecting or extending to an upright post 60 having a tubular channel 61 serving two functions, one to accommodate a screw 62 having a hollow interior 63 threaded at one end and the other function, to provide a pathway for the electrical connections of the transducers (not shown) on the pickup. The post 60 has a top section 64 that can pivot around the screw 62. The hollow interiored screw 62 attaches to a bottom section 65 of the post 60 by a male-female connection of a threaded section of the channel 61 with the threaded end of the screw 62. The bottom section 65 of the post is stationary. For a slidable top pickup as shown in FIG. 8, at the bottom edge of the post 60, are protruding ends 66 for allowing the post 60 to traverse along a track or a rail 67 that is mounted at the front panel 10 of the guitar. The rail or track serves the same purpose as the tracking bars 52. It allows the top pickup to position itself above the strings 5 at any location along the length of the track 67. FIG. 9 shows a guitar with a swinging top pickup. The post and the track can be of any comparable design so long as the functions stated herein can be achieved. As in the other top pickup assembly, the swinging top pickup holder 58 is connected to the top pickup 1 with a spring enveloped hex screw 68 to be able to finely adjust the distance between the top pickup and the strings. Likewise, the rails or track 67 can be mounted or installed on the top panel of the guitar at a desired angle or inclination if this is necessary to maintain a constant distance between the strings and the top pickup.

Although the bottom pickup/s can be adjusted during play, it is recommended to fix the position of the bottom pickup/s prior to play based on the type of music or musical tones to be played. It is also recommended to fix the position of the top pickup based on the desired tone and/or pitch and move this only between songs or musical piece, if required or if possible based on the tone desired by the music. In a guitar with both a bottom and top pickup, it is recommended not to move the bottom pickup/s as often as the top pickup, the latter taking care of fine tuning the tone/pitch adjustments since it is more maneuverable than the bottom pickup. With the presence of the top pickup, it is probable to find the desired tune without the need of readjusting the bottom pickup/s. Tuning the guitar is usually accomplished by adjusting the location of either the top or bottom pickup or both which may be aided by the switch, activating or inactivating the pickups. As stated above, the top pickup can also be moved during and not just between a musical piece, if necessary, to produce the desired tone and/or pitch.

The use of the term "connect", "attach", "mount", "install" include direct or indirect connections with or without intervening or intermediary devices or other means that can couple or attach or fix the parts together or the parts with other components or sections of the guitar.

While the embodiments of the present invention have been described, it should be understood that various changes, adaptations, and modifications may be made therein without departing from the spirit of the invention and the scope of the claims.

I claim:

1. A musical stringed instrument, comprising:

a body including a neck and a bridge, the neck and bridge having anchoring elements supporting a string or a plurality of strings;

a top pickup mounted on top of the string or plurality of strings that can swing into and out of a zone of the string vibration; and, means for installing or removing the top pickup on a front panel of the stringed instrument.

2. The instrument of claim 1 wherein the top pickup is permanently or slidably mounted on top of the string.

3. The instrument of claim 2 further comprising means for effecting slidable movement of the top pickup along a usable length of the string.

4. The instrument of claim 1 further comprising means for maintaining a distance between the top pickup and the string.

5. The instrument of claim 1 further comprising a bottom pickup permanently or slidably mounted on a rear panel of the musical stringed instrument beneath the strings and means for installing the bottom pickup on the musical stringed instrument.

6. The instrument of claim 5 wherein the bottom pickup is a single or double pickup.

7. The instrument of claim 5 wherein the bottom pickup is more than one.

8. The instrument of claim 7 wherein the multiple bottom pickup is a single or a double pickup or a combination of these.

9. The instrument of claim 5 further comprising means for effecting slidable movement of the bottom pickup along a usable length of the string.

10. The instrument of claim 5 further comprising means for maintaining a distance between the bottom pickup and the string.

11. The instrument of claim 5 further comprising a means to activate or inactivate the bottom pickup.

12. A musical stringed instrument, comprising:

a body including a neck and a bridge, the neck and bridge having anchoring elements supporting a string or a plurality of strings;

a top pickup mounted on top of the string or plurality of strings;

a slidable bottom pickup mounted beneath the string or plurality of strings;

means for effecting slidable movement of the bottom pickup along a usable length of the string;

means for installing or removing the top pickup on a front panel of the stringed instrument;

means for installing the bottom pickup on a rear panel of the stringed instrument;

means for maintaining a distance between the top pickup and the string; and, means for maintaining a distance between the bottom pickup and the string.

13. A musical stringed instrument, comprising:

a body including a neck and a bridge, the neck and bridge having anchoring elements supporting a string or a plurality of strings;

a top pickup mounted on top of the string or plurality of strings, the top pickup permanently mounted or slidably mounted in a direction parallel to the strings;

a plurality of bottom pickup mounted beneath the string or plurality of strings, the bottom pickup permanently mounted or slidably mounted in a direction parallel to the strings;

means for effecting slidable movement of the pickups along a usable length of the string;

means for installing or removing the top pickup on a front panel of the stringed instrument;

means for installing the bottom pickup on a rear panel of the stringed instrument;

means for maintaining a distance between the top pickup and the string; and, means for maintaining a distance between the bottom pickup and the string.

14. The instrument of claim 13 further comprising a switch to activate or inactivate the top or bottom pickup.

15. The instrument of claim 12 wherein the bottom pickup is a single or double pickup.

16. The instrument of claim 13 wherein the multiple bottom pickup is a single or a double pickup or a combination of these.

17. A musical stringed instrument, comprising:

a body including a neck and a bridge, the neck and bridge having anchoring elements supporting a string or a plurality of strings;

a slidable top pickup mounted on top of the string or plurality of strings;

means for effecting slidable movement of the top pickup along a usable length of the string;

means for maintaining a distance between the top pickup and the string; and, means for installing or removing a top pickup on a front panel of the stringed instrument.

18. The instrument of claim 17 further comprising a bottom pickup permanently or slidably mounted on a rear panel of the musical stringed instrument beneath the strings and means for installing the bottom pickup on the musical stringed instrument.

19. The instrument of claim 18 wherein the bottom pickup is a single or double pickup.

20. The instrument of claim 18 wherein the bottom pickup is more than one.

21. The instrument of claim 20 wherein the multiple bottom pickup is a single or a double pickup or a combination of these.

* * * * *